United States Patent [19]

Bishop

[11] 4,057,255

[45] Nov. 8, 1977

[54] GOLF SWING AID

[76] Inventor: Forest M. Bishop, 1217 George Washington Way No. 76, Richland, Wash. 98352

[21] Appl. No.: 692,849

[22] Filed: June 4, 1976

[51] Int. Cl.[2] ..... A63B 69/36

[52] U.S. Cl. ..... 273/189 R; 273/166; 2/161 A

[58] Field of Search ..... 273/183 B, 165, 166; 2/161 A, 188 R, 188 A, 190 R, 190 A

[56] References Cited

U.S. PATENT DOCUMENTS

| | | | |
|---|---|---|---|
| 2,709,257 | 5/1955 | McKinney | 2/161 A |
| 3,274,616 | 9/1966 | Russo | 273/166 UX |

*Primary Examiner*—George J. Marlo
*Attorney, Agent, or Firm*—Eugene D. Farley

[57] ABSTRACT

A golf swing aid comprises a glove having a thumb and a substantial wrist band integrated with the open end of the glove. A flexible tie is connected at one of its ends to the end portion of the thumb and has a length sufficient to overlie the back of the thumb. An adjustable fastener is mounted on the wrist band substantially aligned with the thumb in the use position of the glove. In use, the free end of the tie is secured in the address position, becomes limp during the back swing because of cocking of the wrist, and becomes taut during the down swing, assisting the golfer to unflex his wrists to their address position, thereby assisting in hitting the ball squarely.

6 Claims, 3 Drawing Figures

GOLF SWING AID

BACKGROUND AND SUMMARY OF THE INVENTION

This invention pertains to golf swing aids. It pertains particularly to a glove-type golf swing aid which assists the golfer in hitting the ball squarely.

As is well known, when a golfer addresses the golf ball and makes his shot there occur two movements of the wrist: lateral and vertical. The lateral movement is involved in the short swing, such as is used in making a chip or putt or even a short pitch when the back swing is short. However, as the back swing is lengthened, the wrist action changes from lateral to vertical.

To illustrate, if the club is held in address position and the wrists flexed without moving the arms, the clubhead raises directly upwardly. This is vertical wrist movement.

This same movement occurs during a long back swing.

When making a full swing, it is easy for the golfer to picture and control the lateral movement of the arms and hands as they move on the projected line of flight. However, it is difficult for him to control vertical wrist movement. Such movement is of the greatest importance, however, since as the wrists are flexed vertically on the top of the back swing, so they must be unflexed accurately on the down swing. If they are not unflexed enough, the club will make contact too high on the ball. If they are unflexed too much, the club will strike the ground under the ball.

It is the purpose of the present invention to provide a simple, effective golf swing aid which enables the golfer to control the vertical movement of his wrists on the down swing so that they assume exactly the address position at the moment of impact with the ball, thereby helping the golfer to hit the ball squarely.

Other objects of the invention are the provision of a golf swing aid which is relatively simple in construction, easily put on and taken off, easily and accurately adjustable, comfortable when worn, effective, and relatively inexpensive.

In essence, the golf swing aid accomplishing the foregoing and other objects of the invention comprises a glove having a thumb and a substantial wrist band integrated with or attached to its open end. A flexible tie is connected at one of its ends to the end of the thumb. The tie has a length sufficient to overlie the back of the thumb to the wrist band. Adjustable securing means on the wrist band maintain the tie substantially aligned with the thumb. In use, the securing means is fastened in the address position. It then will flex as the golfer's wrists flex during the back swing. However, it will become taut on the down swing, assisting the golfer to return the club to the position of address.

DESCRIPTION OF A PREFERRED EMBODIMENT OF THE INVENTION

Figures 1, 2, 3:
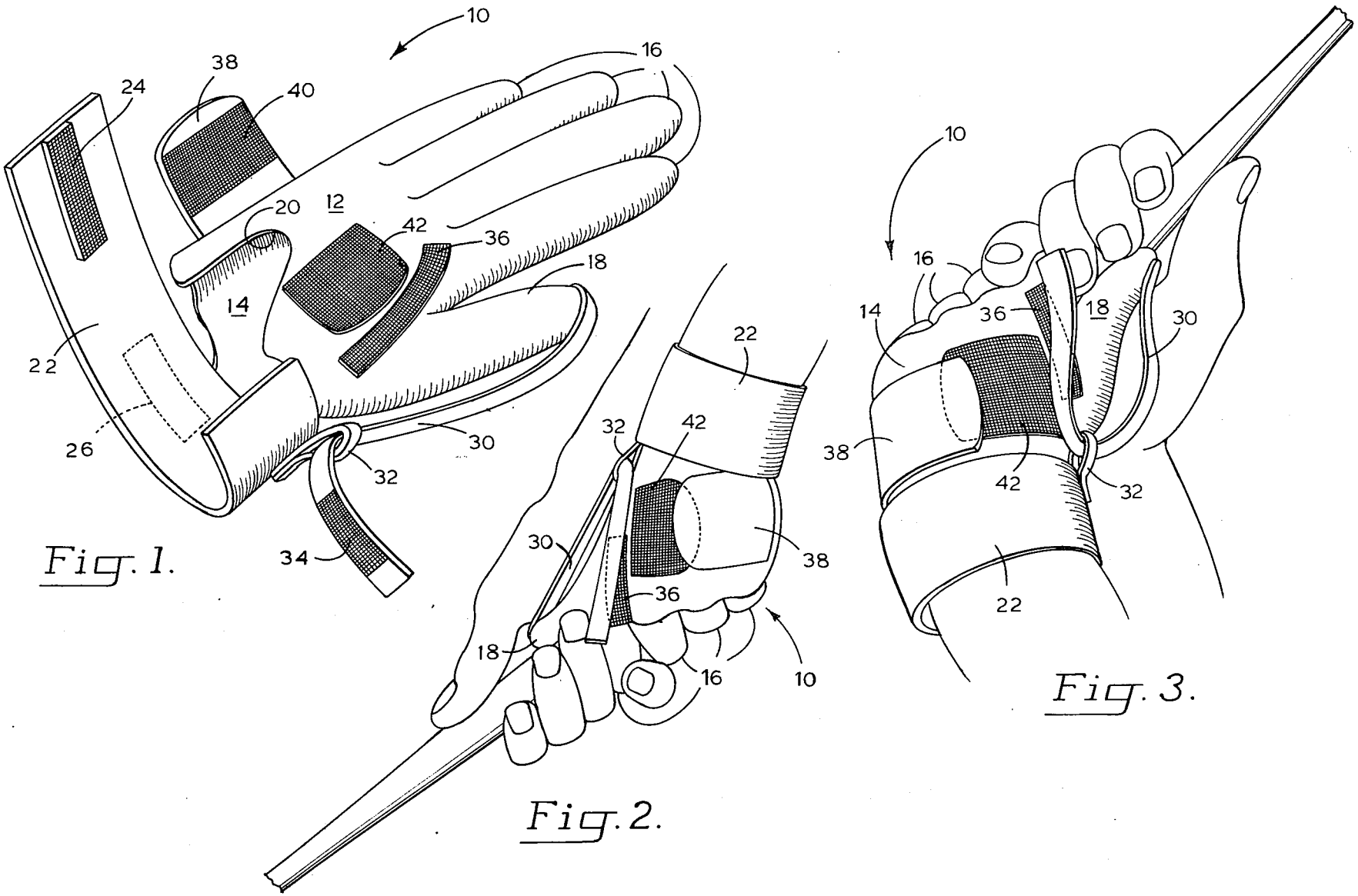
FIG. 1 is a perspective view of the hereindescribed golf swing aid in its open, storage position.
FIG. 2 is a perspective view of the golf swing aid as worn by the golfer and illustrating the condition of the aid in the address position.
FIG. 3 is a perspective view of the golf swing aid as worn by the golfer and illustrating its condition at the top of the back swing.

Referring to FIG. 1:

The golf swing aid of my invention includes a glove indicated generally at 10. As illustrated, this is the left hand glove worn by a right handed golfer. The invention is equally applicable, however, with suitable modification, to a right hand glove worn by a left handed golfer.

The glove is conventional and indeed may comprise a commercial glove adapted for the present purpose.

Thus the glove includes a back portion 12, a front or palm portion 14, fingers 16 and a thumb 18. As is conventional, the back portion may be cut away at 20 to facilitate putting on the glove.

A substantial wrist band 22 may be integral with the upper open end of the glove or, as illustrated, is attached to the upper end of the palm portion by sewing. The wrist band preferably comprises a strip of canvas or other strong, durable, flexible fabric. It is provided with fasteners, preferably burr type ("Velcro") fasteners 24, 26. Conceivably, suitably positioned snap fasteners could be used, the object being to be able to fasten the wrist band snugly and securely about the wrist, because it is the anchor point for the instrumentality achieving the desired aid in guiding the down swing.

This instrumentality comprises flexible tie means 30. The tie means advantageously may comprise a strap of woven fabric of such a character that it will not stretch appreciably when subjected to tension. One end of the strap is connected by sewing or otherwise to the end of the thumb. The tie is of sufficient length to overlie the back of the thumb, aligned therewith, and to reach the central portion of the wrist band. There it may be secured in a position of measured tension at address.

However, in order to make the strap adjustable to suit different golfers, having different sized hands, cocking their wrists differently during address and back swing, it is preferred to provide on the wrist band at the indicated location a guide through which the tie passes. The guide is indicated at 32. It comprises a loop of flexible material. For example, it may comprise the same material as is used in fabricating the tie, sewn or otherwise affixed to the wrist band in a central location.

In the illustrated embodiment, tie 30 is of sufficient length so that after passing it through guide 32 it may be bent reversely and extended to a selected location on the back of the glove. A preferred location is the area between the base of the thumb and the base of the index finger.

Fastening means are provided for fastening the end of the tie to the back of the glove. Again burr type fastening means are preferred, there being one such fastener 34 on the end of the tie and another 36 on the back of the glove.

Further to brace a hand and increase the accuracy with which the tie strap may be adjusted, there optionally is provided a brace strap 38. One end of the strap is connected to the glove at the seam between the face and back portion, opposite the thumb. The free end mounts a fastener 40, again a burr type fastener. A companion fastener 42 is mounted in an appropriate location on the back of the glove.

In the use of the golf swing aid, glove 10 is placed on the left hand. Brace strap 38 is secured snugly across the back of the hand. Wrist band 22 is secured snugly about the wrist. Tie strap 30 is inserted through loop 32 with its end hanging free, as in FIG. 1.

The golfer then assumes the position of address. In this position he or a companion fastens the end of tie strap 30 to fastener 36 in such a manner that the tie strap is comfortably under tension. At this point there will be a feeling of reduced weight of the club head. If the tie strap is pulled too taut, there is a tendency for the club head to be raised vertically. The normal, taut position of the tie strap is illustrated in FIG. 2.

Next the golfer makes his back swing. At the top of the back swing the tie strap condition of FIG. 3 prevails. It will be noted that the tie strap is loose, because the wrists have been flexed upwardly.

During the downswing the wrists are flexed downwardly. As they approach the address position of FIG. 2, the tie strap again will become taut. The golfer will feel this and accordingly will desist from bending his wrists downwardly any further. Conditions thus are set for hitting the ball squarely. In this manner the device assists the golfer in grooving his swing so that with time and practice his wrists will flex and unflex correctly.

Having thus described my invention in preferred embodiments, I claim:

1. A golf swing aid for establishing a desired condition of vertical unflexing of the wrist in the golf ball address position of a golfer, the aid comprising:

a. a glove having a front, a back and a thumb, b. a substantial wrist band on the open end of the glove, c. a flexible, substantially inelastic tie member connected at one of its ends to the forward end of the thumb, and having a length sufficient to extend rearward over the back of the thumb to the wrist band, and d. connecting means on the wrist band substantially aligned with the thumb in the use position of the glove and engaging the tie member for interconnecting the forward end of the thumb and the wrist band in a selected condition of tension of the tie member for establishing a desired condition of vertical unflexing of the wrist in the address position.

2. The golf swing aid of claim 1 wherein the connecting means includes a guide on the wrist band substantially aligned with the thumb, the flexible tie member is of a length sufficient to extend rearward along the back of the thumb through the guide and in a reverse bend to overlie a selected portion of the back of the glove, and mutually interengageable fasteners on said selected portion of the glove back and on the free end of the tie member.

3. The golf swing aid of claim 2 wherein the guide comprises a flexible, substantially inelastic loop.

4. The golf swing aid of claim 1 wherein the wrist band normally is open and has on its free ends fastening means for adjustably securing them about the wrist in the use position of the aid.

5. The golf swing aid of claim 1 including a reinforcing brace strap on the back of the glove, and a fastener for fastening the strap across the back of the glove to brace the hand of the golfer.

6. A golf swing aid for establishing a desired condition of vertical unflexing of the wrist in the golf ball address position of a golfer, the aid comprising:

a. a glove having a front, a back and a thumb, b. a substantial wrist band on the open end of the glove, c. the wrist band comprising an open strip of flexible fabric having fasteners for securing its ends about the wrist in overlapped condition, d. a substantially inelastic guide on the wrist band substantially aligned with the thumb in the use position of the glove, e. a flexible, substantially inelastic tie member connected at one of its ends to the forward end of the thumb and having a length sufficient to be extended rearwardly over the back of the thumb and to be passed through the guide, bent reversely and to overlie a selected area of the glove back, and f. tie fastening means for releasably securing the free end of the tie member to the glove back in said selected area, for maintaining the tie member in a condition of predetermined tension for establishing a desired condition of vertical unflexing of the wrist in the address position.

* * * * *